US010077787B2

(12) United States Patent
Arikawa

(10) Patent No.: US 10,077,787 B2
(45) Date of Patent: Sep. 18, 2018

(54) ACCUMULATOR

(71) Applicant: EAGLE INDUSTRY CO., LTD., Tokyo (JP)

(72) Inventor: Tatsuhiro Arikawa, Tokyo (JP)

(73) Assignee: Eagle Industry Co., Ltd. (JP)

( * ) Notice: Subject to any disclaimer, the term of this patent is extended or adjusted under 35 U.S.C. 154(b) by 78 days.

(21) Appl. No.: 15/117,890

(22) PCT Filed: Mar. 11, 2015

(86) PCT No.: PCT/JP2015/057084
§ 371 (c)(1),
(2) Date: Aug. 10, 2016

(87) PCT Pub. No.: WO2015/137371
PCT Pub. Date: Sep. 17, 2015

(65) Prior Publication Data

US 2017/0009782 A1 Jan. 12, 2017

(30) Foreign Application Priority Data

Mar. 11, 2014 (JP) ..... 2014-047099

(51) Int. Cl.
*F15B 1/10* (2006.01)
*F15B 1/02* (2006.01)
*F15B 20/00* (2006.01)

(52) U.S. Cl.
CPC ..... *F15B 1/103* (2013.01); *F15B 1/021* (2013.01); *F15B 20/007* (2013.01); *F15B 2201/3153* (2013.01); *F15B 2201/41* (2013.01)

(58) Field of Classification Search
CPC ..... F15B 1/103; F15B 1/021; F15B 20/007; F15B 2201/3153; F15B 2201/41
(Continued)

(56) References Cited

U.S. PATENT DOCUMENTS 7,377,292 B2 * 5/2008 Mori ..... F15B 1/103 138/26
7,810,522 B1 10/2010 Nakaoka et al.
(Continued)

FOREIGN PATENT DOCUMENTS

CN 101809294 A 8/2010
CN 101821514 A 9/2010
(Continued)

OTHER PUBLICATIONS

Extended European Search Report for European Application No. 15762387.7, dated Jan. 20, 2017 (7 pages).

*Primary Examiner* — Craig Schneider
*Assistant Examiner* — David Deal
(74) *Attorney, Agent, or Firm* — Harness, Dickey & Pierce, P.L.C.

(57) ABSTRACT

The invention provides an accumulator which can reduce the number of the parts of the pressure fluctuation absorption mechanism at the liquid expanding time, can simplify assembling and can reduce a cost of the parts. The accumulator has a seal holder which is provided in a bellows cap, and a plate-like seal which is retained by the seal holder. The seal holder is provided with an inward flange-like outer peripheral side engagement portion, and the seal is provided with an outward projection-like inner peripheral side engagement portion which is arranged in an outer peripheral surface of a seal main body and is made of a rubber-like elastic body engaging with the outer peripheral side engagement portion. The bellows cap moves to a position where liquid pressure and gas pressure are balanced with the seal seating on a seat surface due to difference in pressure receiving area.

5 Claims, 11 Drawing Sheets

(58) Field of Classification Search
USPC ..... 138/31, 30, 26
See application file for complete search history.

(56) References Cited

U.S. PATENT DOCUMENTS

| | | | | |
|---|---|---|---|---|
| 2010/0108168 | A1 | 5/2010 | Ota et al. | |
| 2010/0193059 | A1* | 8/2010 | Nakaoka | F15B 1/103 138/31 |
| 2011/0226370 | A1* | 9/2011 | Arikawa | F15B 1/103 138/30 |

FOREIGN PATENT DOCUMENTS

| | | | |
|---|---|---|---|
| CN | 102227563 | A | 10/2011 |
| CN | 103148029 | A | 6/2013 |
| CN | 103244474 | A | 8/2013 |
| CN | 104583606 | A | 4/2015 |
| EP | 1975417 | A1 | 10/2008 |
| EP | 2957776 | A1 | 12/2015 |
| JP | 3148349 | U | 2/2009 |
| JP | 2009236165 | A | 10/2009 |
| JP | 2010112431 | A | 5/2010 |
| JP | 2011226557 | A | 11/2011 |

* cited by examiner

ACCUMULATOR

CROSS-REFERENCE TO RELATED APPLICATIONS

This application is a U.S. National Phase Application under 35 U.S.C. 371 of International Application No. PCT/JP2015/057084, filed on Mar. 11, 2015 and published in Japanese as WO2015/137371 on Sep. 17, 2015. This application claims priority to Japanese Patent Application No. 2014-047099, filed on Mar. 11, 2014. The entire disclosures of the above applications are incorporated herein by reference.

BACKGROUND OF THE INVENTION

Field of the Invention

The present invention relates to an accumulator which is used as a pressure accumulator or a pulsation pressure damping device. The accumulator according to the present invention is used, for example, for a hydraulic piping in a vehicle such as a motor vehicle.

Description of the Conventional Art

The inventors of the present invention have previously proposed an accumulator 51 shown in FIGS. 9 to 11, and the accumulator 51 according to the prior art is structured as follows (refer to Japanese Unexamined Patent Publication No. 2010-112431).

(i) More specifically, the accumulator 51 has an accumulator housing 52 which is provided with an oil port 53 connected to a pressure piping, a stay 54 which is arranged closer to an inner side than the oil port 53 within the housing 52 and is provided with a liquid outlet and inlet 54*c* in an end surface portion 54*b* in a leading end of a tubular portion 54*a*, a bellows 55 which is arranged in an outer peripheral side of the stay 54 and is coupled its fixed end to the oil port 53, a bellows cap 56 which is coupled to a floating end of the bellows 55, a gasket holder 57 which is provided on a surface closer to the stay 54 side in the bellows cap 56, and a discoid gasket 58 which is held by the gasket holder 57 in a state in which the discoid gasket 58 can relatively move in an extending and contracting direction of the bellows 55, as shown in FIG. 9, and a gas chamber 59 is set to an outer peripheral side of the bellows 55 and a liquid chamber 60 is set to an inner peripheral side of the bellows 55.

(ii) At the steady activating time of the pressure piping, the discoid gasket 58 moves in the extending and contracting direction of the bellows 55 together with the bellows cap 56, and balances liquid pressure and gas pressure.

(iii) In the case that the operation of the device stops and the pressure of the pressure piping is extremely lowered (so-called zero-down time), the discoid gasket 58 moves together with the bellows cap 56 and seats on a seat surface 54*d* of the stay end surface portion 54*b* so as to close the liquid chamber 60 as shown in FIG. 10. Therefore, the liquid is partially confined in the closed liquid chamber 60, and a state in which the liquid pressure and the gas pressure are balanced is maintained. As a result, the bellows 55 is prevented from being broken by pressure unbalance.

(iv) In the case that the liquid confined in the liquid chamber 60 is expanded due to rise in an atmospheric temperature at the zero-down time, the bellows cap 56 moves toward a position where the liquid pressure and the gas pressure are balanced, with a state in which the discoid gasket 58 seats on the seat surface 54*d* of the stay end surface portion 54*b* kept due to difference in the pressure receiving area in both upper and lower surfaces of the discoid gasket 58 as shown in FIG. 11. Therefore, since the state in which the liquid pressure and the gas pressure are balanced is still maintained, the bellows 55 is prevented from being broken.

(v) As a pressure fluctuation absorption mechanism at the liquid expanding time mentioned above, in addition to the gasket holder 57 and the discoid gasket 58, a wave spring 61 and a spring plate 62 are interposed between them, the wave spring 61 and the spring plate 62 elastically energizing the discoid gasket 58 in a direction of pressing the discoid gasket 58 toward the bellows cap 56. A spacer portion 63 is provided on a surface closer to the bellows cap 56 side of the gasket 58, the bellows cap 56 comes into contact with the spacer portion 63 at the zero-down time, and the gas encapsulated in the gas chamber 59 presses the gasket to the stay 54 due to the pressure (the gas pressure) so as to seal. There is a case that the zero-down is carried out with a slight gap provided between the bellows cap 56 and the spacer portion 63. Further, in any event, in the case that the liquid confined in the liquid chamber 60 is expanded from this state, the bellows cap 56 moves toward the position where the liquid pressure and the gas pressure are balanced while compressing the wave spring 61.

Since the accumulator 51 having the above structure has the pressure fluctuation absorption mechanism as mentioned above, the liquid pressure and the gas pressure can be still balanced in the case that the liquid confined in the liquid chamber 60 is expanded at the zero-down time. As a result, the bellows 55 can be prevented from being broken, however, there is room for improvement in the following points.

More specifically, since the pressure fluctuation absorption mechanism has the wave spring 61 and the spring plate 62 in addition to the gasket holder 57 and the discoid gasket 58 as mentioned above, the number of the parts is increased, it takes time and effort in assembling and a cost of the parts is high.

Since it is necessary to elongate the gasket holder 57 at a length of the wave spring 61 and a thickness of the spring plate 62, a problem that the gasket holder 57 interferes with the stay 54 may be caused. Consequently, it is necessary to provide a step portion 54*e* for clearance in a shoulder portion of the stay 54 as shown in the drawing. As a result, a shape and a manufacturing of the stay 54 are complicated.

Further, the pressure fluctuation absorption mechanism mentioned above can respond to the case that the liquid confined in the liquid chamber 60 is expanded at the zero-down time, however, can not respond to the case that the liquid confined in the liquid chamber 60 is contracted at the zero-down time.

SUMMARY OF THE INVENTION

Problem to be Solved by the Invention

The present invention is made by taking the above points into consideration, and an object of the present invention is to provide an accumulator which can reduce the number of the parts of the pressure fluctuation absorption mechanism at the liquid expanding time in comparison with the prior art, can simplify assembling and can reduce a cost of the parts. In addition, an object of the present invention is to provide an accumulator which can respond not only to the expanding time of the liquid confined in the liquid chamber at the zero-down time but also to the contracting time, and can balance the liquid pressure and the gas pressure.

Means for Solving the Problem

In order to achieve the object mentioned above, an accumulator according to claim 1 of the present invention has an accumulator housing which is provided with an oil port connected to a pressure piping, a bellows and a bellows cap which are arranged within the housing and compart a space within the housing into a liquid chamber communicating with the oil port and a gas chamber encapsulating gas therein, a seal holder which is provided in the bellows cap, and a plate-like seal which is retained by the seal holder, wherein the seal holder is provided with an attaching portion to the bellows cap, and an inward flange-like outer peripheral side engagement portion, and the seal is provided with a seal main body which has a smaller diameter than an inner diameter of the outer peripheral side engagement portion, and an outward projection-like inner peripheral side engagement portion which is arranged in an outer peripheral surface of the seal main body and is made of a rubber-like elastic body engaging with the outer peripheral side engagement portion.

Further, an accumulator according to claim 2 of the present invention is the accumulator described in claim 1 mentioned above, wherein the seal holder is provided with an inward flange-like second outer peripheral side engagement portion in the same manner in the bellows cap side of the outer peripheral side engagement portion, and the seal is structured such that the inner peripheral side engagement portion is arranged between the outer peripheral side engagement portion and the second outer peripheral side engagement portion, and an initial gap is set between the seal and the bellows cap.

Further, an accumulator according to claim 3 of the present invention is the accumulator described in claim 1 or claim 2 mentioned above, wherein the inner peripheral side engagement portion is formed thinner than the seal main body.

Further, an accumulator according to claim 4 of the present invention is the accumulator described in claim 1, 2 or 3 mentioned above, wherein the inner peripheral side engagement portion is circumferentially divided into a plurality of sections.

In the accumulator according to the present invention having the above structure, since the outward projection-like inner peripheral side engagement portion constructed by the rubber-like elastic body is provided on an outer peripheral surface constructing the seal, the inner peripheral side engagement portion acts as a spring means in place of the wave spring in the above prior art. The spring means is adapted to relatively move the seal and the bellows cap and return the seal and the bellows cap to the initial moving position after the activation. Therefore, according to the accumulator of the present invention having the above structure, the wave spring and the spring plate can be omitted from the structure of the pressure fluctuation absorption mechanism having the seal holder and the seal.

The inner peripheral side engagement portion is combined with the inner flange-like outer peripheral side engagement portion which is provided in the seal holder, and acts as follows.

More specifically, in the first instance, the inner peripheral side engagement portion is not elastically deformed too much but engages with the outer peripheral side engagement portion of the seal holder at the steady activating time. Therefore, the seal moves together with the seal holder and the bellows cap in a state in which the seal is retained by the seal holder. At this time, the seal comes into contact with the bellows cap, however, a little initial gap may be set between the seal and the bellows cap.

In the case that the pressure of the pressure piping is extremely lowered due to the operation stop of the device (the so-called zero-down time), the seal moves together with the seal holder and the bellows cap so as to seat on the seat surface, and closes the liquid chamber. At this time, since the bellows cap is pushed by the gas pressure, the outer peripheral side engagement portion comes away from the inner peripheral side engagement portion.

In the case that the liquid confined in the liquid chamber is expanded due to the rise of the atmospheric temperature at the zero-down time, the seal holder and the bellows cap move toward the position where the liquid pressure and the gas pressure are balanced with the seal seating on the seat surface kept due to the difference in the pressure receiving area between both the upper and lower surfaces of the seal, and the seal holder and the bellows cap move at this time in a state in which the outer peripheral side engagement portion of the seal holder elastically deforms the inner peripheral side engagement portion of the seal. In the case that the initial gap is set between the seal and the bellows cap as mentioned above, the outer peripheral side engagement portion comes into contact with the inner peripheral side engagement portion when the seal holder and the bellows cap start moving, and after the contact the seal holder and the bellows cap move while the inner peripheral side engagement portion elastically deforming.

Since the inner peripheral side engagement portion is constructed by the rubber-like elastic body and elastically deforms, the inner peripheral side engagement portion elastically returns when the load or the pressure acting on the inner peripheral side engagement portion is removed. Therefore, the seal, the seal holder and the bellows cap are returned to the state at the above steady activating time.

As mentioned above, the inner peripheral side engagement portion of the seal is combined with the outer peripheral side engagement portion of the seal holder so as to act as the spring means, and can respond to the case that the liquid confined in the liquid chamber is expanded.

Further, in order to respond not only to the case that the liquid confined in the liquid chamber is expanded but also to the case that the liquid is contracted, there can be thought that the outer peripheral side engagement portions are provided at two positions of the seal holder, and the inner peripheral side engagement portion is combined with the outer peripheral side engagement portions at two positions. In this case, the outer peripheral side engagement portions at two positions are constructed by the first outer peripheral side engagement portion and the second outer peripheral side engagement portion which is arranged closer to the bellows cap than the first outer peripheral side engagement portion, and the inner peripheral side engagement portion of the seal is arranged between both the outer peripheral side engagement portions. Further, the initial gap is essentially set between the seal and the bellows cap. The activation thereof is as follows.

More specifically, in the first instance, the inner peripheral side engagement portion is not elastically deformed too much but is positioned between both the outer peripheral side engagement portions of the seal holder at the steady activating time. Therefore, the seal moves together with the seal holder and the bellows cap in a state in which the seal is retained by the seal holder.

In the case that the pressure of the pressure piping is extremely lowered due to the operation stop of the device (the so-called zero-down time), the seal moves together with the seal holder and the bellows cap so as to seat on the seat surface, and closes the liquid chamber.

In the case that the liquid confined in the liquid chamber is expanded due to the rise of the atmospheric temperature at the zero-down time, the seal holder and the bellows cap move toward the position where the liquid pressure and the gas pressure are balanced while keeping the seal seating on the seat surface due to the difference in the pressure receiving area between both the upper and lower surfaces of the seal, and the seal holder and the bellows cap move at this time in a state in which the first outer peripheral side engagement portion of the seal holder elastically deforms the inner peripheral side engagement portion of the seal. Further, in the case that the liquid confined in the liquid chamber is contracted due to the reduction of the atmospheric temperature at the above zero-down time, the seal holder and the bellows cap move toward the position where the liquid pressure and the gas pressure are balanced with the seal seating on the seat surface kept due to the difference in the pressure receiving area between both the upper and lower surfaces of the seal, and the seal holder and the bellows cap move at this time in a state in which the second outer peripheral side engagement portion of the seal holder elastically deforms the inner peripheral side engagement portion of the seal.

Since the inner peripheral side engagement portion is constructed by the rubber-like elastic body and elastically deforms, the inner peripheral side engagement portion elastically returns when the load or the pressure acting on the inner peripheral side engagement portion is removed. Therefore, the seal, the seal holder and the bellows cap are returned to the state at the above steady activating time.

As mentioned above, the inner peripheral side engagement portion is combined with the first and the second outer peripheral side engagement portions so as to act as the spring means, and can respond to both of the case that the liquid confined in the liquid chamber is expanded, and the case that the liquid is contracted.

Since the inner peripheral side engagement portion tends to elastically deform by being made thinner, the inner peripheral side engagement portion is preferably formed thin. Further, since the inner peripheral side engagement portion tends to elastically deform in the case that it is not formed into an annular shape in comparison with the case that it is formed into the annular shape, the inner peripheral side engagement portion is preferably divided into a plurality of sections circumferentially.

Effect of the Invention

The present invention achieves the following effects.

More specifically, in the present invention, since the outward projection-like inner peripheral side engagement portion constructed by the rubber-like elastic body is provided on the outer peripheral surface of the seal main body constructing the seal as mentioned above, the outward projection-like inner peripheral side engagement portion constructed by the rubber-like elastic body is combined with the outer peripheral side engagement portion of the seal holder so as to act as the spring means. Therefore, the wave spring and the spring plate can be omitted from the structure of the pressure absorption mechanism having the seal holder and the seal. As a result, it is possible to reduce the number of the parts of the pressure fluctuation absorption mechanism, simplify the assembling and reduce the cost of the parts as initially intended. Further, there can be additionally provided the accumulator which can respond not only to the case that the liquid is expanded but also to the case that the liquid is contracted, by the combination of the inner peripheral side engagement portion of the seal with the first and the second outer peripheral side engagement portions of the seal holder. Further, the inner peripheral side engagement portion further tends to deform by forming the inner peripheral side engagement portion thin or peripherally dividing the inner peripheral side engagement portion into a plurality of sections. As a result, it is possible to provide the pressure fluctuation absorption mechanism which smoothly absorbs the pressure fluctuation.

DETAILED DESCRIPTION OF PREFERRED EMBODIMENTS

Figure 1:
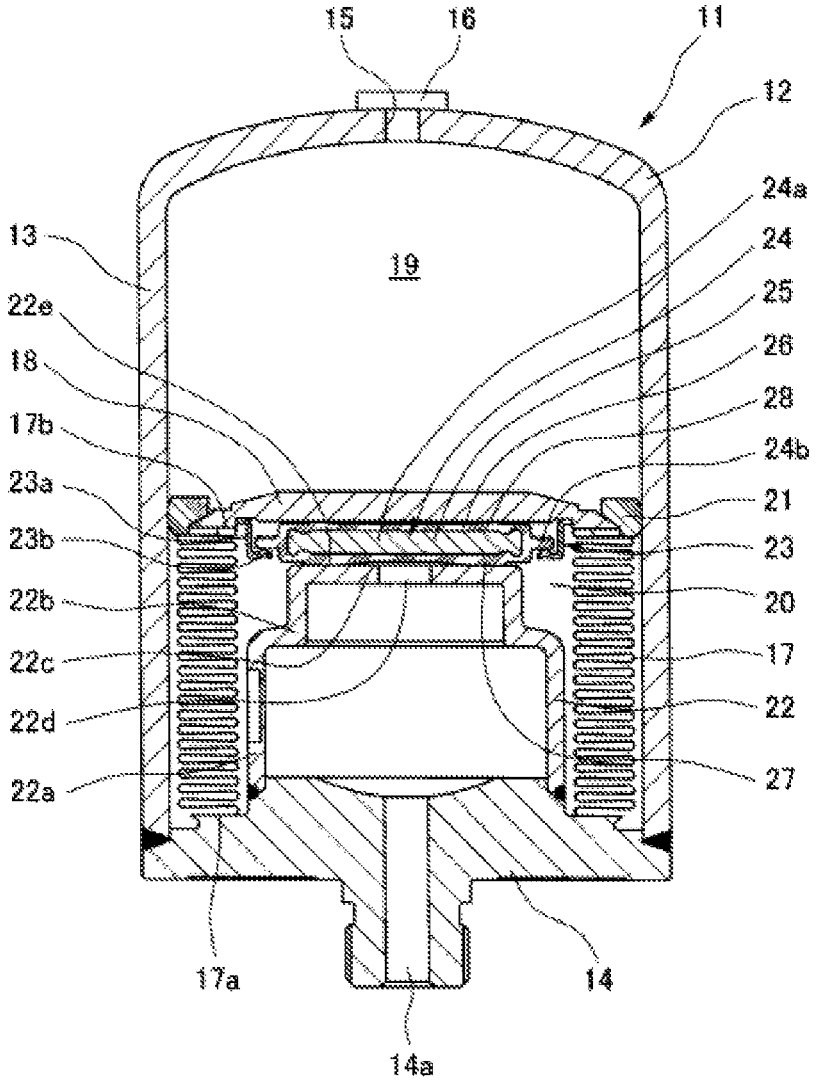
FIG. 1 is a cross-sectional view of an accumulator according to a first embodiment of the present invention.

The following modes are included in the present invention.

(1) A projection-shaped portion is provided in an outer peripheral portion of the seal, and an L-shaped portion of the seal holder comes into contact with the projection-shaped portion or is arranged in the projection-shaped portion with a slight gap. In the case that the fluid is expanded, the L-shaped portion of the seal holder bends the projection-shaped portion in the outer peripheral portion of the seal in an upward direction when the bellows cap starts moving in the upward direction. As a result, the bellows cap moves in the upward direction at an amount of expansion of the fluid. Further, since the L-shaped portion of the seal holder comes into contact with the projection-shaped portion, the seal does not fall away.

(2) A projection-shaped portion is provided in an outer peripheral portion of the seal made of the elastic body. The projection-shaped portion may be circumferentially integrated, however, may be made more deformable by being formed into a divided structure. Further, there can be thought that the projection-shaped portion can be formed into a further easily deformable shape by the provision of grooves or the application of change in thickness.

(3) Since the L-shaped portion of the seal holder comes into contact with the rubber portion, a countermeasure for reducing the friction resistance and preventing scuff mark due to the contact can be achieved by forming the L-shaped portion into a diagonal shape or a semicircular shape.

(4) In the case that the fluid (backup fluid) is expanded, the L-shaped portion of the seal holder bends the projection-shaped portion in the outer peripheral portion of the seal in the upward direction when the bellows cap starts moving in the upward direction. As a result, the bellows cap moves in the upward direction at the amount of expansion of the fluid. However, since the L-shaped portion of the seal holder comes into contact with the projection-shaped portion of the seal, the seal does not fall away.

(5) In the case that the fluid is contracted, an L-shaped portion of the seal holder is provided above the projection-shaped portion in the outer peripheral portion of the seal, and an L-shaped portion is also provided below the same. The lower L-shaped portion is provided for the purpose of preventing the seal from falling away. In the case that the fluid is contracted after the zero-down and the bellows cap and the seal holder start moving in a downward direction, the upper L-shaped portion bends the projection-shaped portion in the downward direction. As a result, the bellows cap moves in the downward direction and absorbs the amount of contraction of the fluid. Further, the lower L-shaped portion has a function of absorbing the expansion of the fluid as mentioned above in addition to the function of preventing the seal from falling away.

Embodiments

Next, a description will be given of embodiments according to the present invention with reference to the accompanying drawings.

First Embodiment

Figure 2:
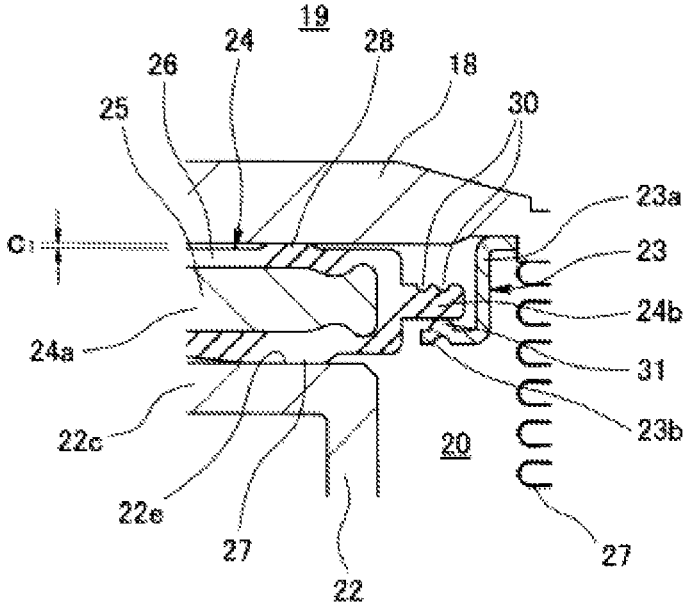
FIG. 2 is an enlarged cross-sectional view of a substantial part of the accumulator.

FIG. 1 shows an entire cross-section of an accumulator 11 according to a first embodiment of the present invention, and an enlarged cross-section of a substantial part thereof is shown in FIG. 2.

The accumulator 11 according to the embodiment is a metal bellows type accumulator which employs a metal bellows as a bellows 17, and is structured as follows.

More specifically, an accumulator housing 12 having an oil port 14 connected to a pressure piping (not shown) is provided, a bellows 17 and a bellows cap 18 are arranged in an inner portion of the housing 12, and an internal space of the housing 12 is comparted into a gas chamber 19 which encapsulates high-pressure gas (for example, nitrogen gas) therein, and a liquid chamber 20 which is communicated with a port hole 14*a* of the oil port 14. The housing 12 is described as a combination of a closed-end cylindrical shell 13, and the oil port 14 which is fixed (welded) to an opening portion of the shell 13, however, a parts distribution structure of the housing 12 is not particularly limited. For example, the oil port 14 and the shell 13 may be integrated, and a bottom portion of the shell 13 may be constructed by an end cover which is separated from the shell 13. In any event, a gas inlet 15 for filling gas in a gas chamber 19 is provided in the bottom portion of the shell 13 or a part corresponding thereto, and is closed by a gas plug 16 after the gas filling.

The bellows 17 is fixed (welded) its fixed end 17*a* to an inner surface of the oil port 14 which corresponds to a port side inner surface of the housing 12, and the discoid bellows cap 18 is fixed (welded) to a floating end 17*b* of the bellows 17. As a result, the accumulator 11 is constructed as an external gas type accumulator in which the gas chamber 19 is set to an outer peripheral side of the bellows 17 and the liquid chamber 20 is set to an inner peripheral side of the bellows 17. A guide 21 is attached to an outer peripheral portion of the bellows cap 18 so as to prevent the bellows 17 and the bellows cap 18 from coming into contact with the inner surface of the housing 12, however, the guide 21 does not achieve a sealing action.

A stay (an internal pedestal) 22 is arranged in an inner side of the oil port 14 within the housing 12, and the bellows 17 is arranged in an outer peripheral side of the stay 22. The stay 22 is obtained by integrally forming an end surface portion 22*c* in one end (an upper end) of a rising portion 22*a* having a tubular shape toward an inner side in a diametrical direction via a step portion 22*b*, and is fixed (welded) to an inner surface of the oil port 14 with the other end (a lower end) of the rising portion 22*a*. A liquid outlet and inlet 22*d* is provided at the center of the end surface portion 22*c*, and a surface (an upper surface) close to the seal 24 side in the end surface portion 22*c* is formed as a seat surface 22*e* on which the seal 24 seats so as to be freely in contact therewith and away therefrom.

A seal holder 23 is fixed to a surface (a lower surface) close to the oil port 14 side in the bellows cap 18. The seal holder 23 is obtained by integrally forming an inward flange-like outer peripheral side engagement portion 23*b* in one end (a lower end) of an attaching portion 23*a* having a tubular shape toward an inner side in a diametrical direction, and is fixed (fitted) to a peripheral edge portion of a concave portion which is provided in a surface close to the oil port 14 side in the bellows cap 18 with the other end bent portion (an upper end bent portion) of the attaching portion 23*a*.

The seal 24 formed into a plate shape and having a discoid shape is retained to an inner peripheral side of the seal holder 23. The seal 24 is provided with a seal main body 24*a* which is set to have a smaller diameter than an inner diameter of the outer peripheral side engagement portion 23*b* of the seal holder 23, and an outward projection-like inner peripheral side engagement portion (also called as an outer peripheral projection portion) 24*b* which is provided on an outer peripheral surface of the seal main body 24*a* and is constructed by a rubber-like elastic body engaging with the outer peripheral side engagement portion 23*b* of the seal holder 23. An outer diameter of the inner peripheral side engagement portion 24*b* of the seal 24 is set to have a larger diameter than the inner diameter of the outer peripheral side engagement portion 23*b* of the seal holder 23, and the inner peripheral side engagement portion 24*b* of the seal 24 engages with the outer peripheral side engagement portion 23*b* of the seal holder 23. As a result, the seal 24 is retained by the seal holder 23 without falling away from the seal holder 23.

The seal main body 24*a* is obtained by attaching (vulcanization bonding) a coating portion 26 constructed by a rubber-like elastic body to a surface of a discoid rigid plate 25 which is made of a metal or a hard resin, a seal portion 27 is formed in a surface (a lower surface) close to the oil port 14 side of the seal 24 by the coating portion 26, the seal portion 27 seating on the seat surface 22*e* of the stay end surface portion 22*c* so as to be freely in contact with and away from, closing the liquid outlet and inlet 22*d* at the seating time and occluding the liquid chamber 20, and a spacer portion 28 is formed in a surface (an upper surface) close to the bellows cap 18 side, the spacer portion 28 coming into contact with the bellows cap 18 so as to be freely in contact with and away from and setting a pressure introducing gap c1 between the seal 24 and the bellows cap 18 at the contacting time.

The gap c1 is set between the seal 24 and the bellows cap 18 by the latter spacer portion 28 as mentioned above for facilitating intrusion of the liquid into a portion between the seal 24 and the bellows cap 18 when the liquid is expanded at the zero-down time (if the space portion 28 is not provided, the seal 24 and the bellows cap 18 are in a closely attached state at the zero-down time, and the liquid is hard to intrude between both the elements 18 and 24 when the liquid is expanded, under the closely attached state. Therefore, such an activation that only the bellows cap 18 moves in a state in which the seal 24 is kept seating on the seat surface 22*e* of the stay 22 is hard to be generated).

The seal portion 27 is formed as an annular projection having predetermined height and diametrical width and achieves a sealing action owing to its annular shape when the seat portion 27 seats on the seat surface 22*e* of the stay 22, thereby closing the liquid outlet and inlet 22*d* and occluding the liquid chamber 20. On the other hand, the spacer portion 28 is formed as an annular projection having predetermined height and diametrical width, however, is provided with a notch portion (not shown) in a part on a circumference. As a result, since the spacer portion 28 is not formed into the annular shape, the spacer portion 28 does not achieve the sealing action even in the case that it comes into contact with the bellows cap 18. Therefore, a pressure receiving area of the surface (the upper surface) close to the bellows cap 18 side in the seal 24 is set to be larger than a pressure receiving area of the surface (the lower surface) close to the oil port 14 side in a state in which the seal 24 seats on the seat surface 22*e* of the stay 22 with the seal portion 27.

Figure 3:
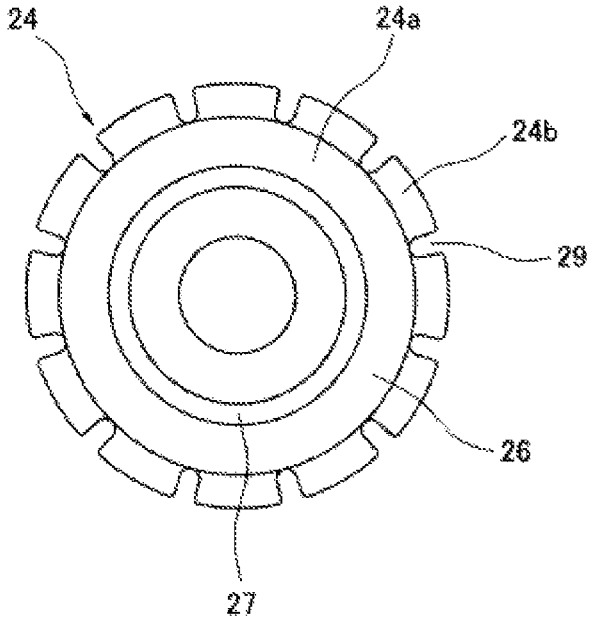
FIG. 3 is a bottom elevational view of a seal which is provided in the accumulator.

The inner peripheral side engagement portion 24*b* of the seal 24 is formed integrally with the coating portion 26 of the seal main body 24*a*. Further, the inner peripheral side engagement portion 24*b* of the seal 24 is formed to be thinner than the seal main body 24*a*, is formed to be thinner than the rigid plate 25 of the seal main body 24*a*, and is arranged approximately at the center in a thickness direction of the seal main body 24*a*. Further, the inner peripheral side engagement portion 24*b* of the seal 24 is divided into a plurality of sections (twelve sections in the drawing) circumferentially as shown in FIG. 3, and a notch portion 29 through which the liquid tends to pass is provided between the divided segments which are adjacent to each other.

In a state in which the inner peripheral side engagement portion 24*b* of the seal 24 is in contact with and engages with the outer peripheral side engagement portion 23*b* of the seal holder 23 as shown in FIG. 2, the spacer portion 28 of the seal 24 is in contact with the bellows cap 18. Therefore, the initial gap is not set between the spacer portion 28 of the seal 24 and the bellows cap 18, however, an initial gap may be set here as mentioned above.

Further, the seal holder 23 and the seal 24 construct the pressure fluctuation absorption mechanism only with these two parts. Therefore, the wave spring and the spring plate according to the prior art are not provided in the pressure fluctuation absorption mechanism.

Next, a description will be given of an activation of the accumulator 11 having the above structure.

Steady Activating Time

The accumulator 11 is connected to the pressure piping of the device (not shown) in the oil port 14. Since the seal 24 is away from the seat surface 22*e* of the stay 22 by moving together with the seal holder 23 and the bellows cap 18 in a state in which the seal 24 is retained by the seal holder 23 at the steady activating time of the pressure piping in the device, the liquid outlet and inlet 22*d* provided in the end surface portion 22*c* of the stay 22 is open. As a result, the port hole 14*a* of the oil port 14 and the liquid chamber 20 are communicated through the liquid outlet and inlet 22*d*, and the liquid having the current pressure is introduced as needed to the liquid chamber 20 from the port hole 14*a* of the oil port 14. Therefore, the bellows cap 18 can move as needed together with the seal holder 23 and the seal 24 so that the liquid pressure and the gas pressure are balanced.

At Zero-Down Time

In the case that the pressure of the pressure piping is extremely lowered to approximately zero from the state at the steady activating time due to the operation stop of the device so as to come to a so-called zero-down state, the liquid within the liquid chamber 20 is discharged little by little from the port hole 14*a* of the oil port 14, and the bellows cap 18 moves in a contracting direction of the bellows 17 in connection with this as shown in FIGS. 1 and 2. Since the seal 24 is retained to the surface close to the stay 22 side of the bellows cap 18 by the seal holder 23, the seal 24 seats on the seat surface 22*e* of the stay 22 in its seal portion 27, and the liquid outlet and inlet 22*d* is closed. Therefore, the liquid chamber 20 is occluded, and the partial liquid (backup fluid) is confined in the liquid chamber 20. As a result, further pressure reduction of the liquid chamber 20 is not generated, and the liquid pressure and the gas pressure are accordingly balanced inside and outside the bellows 17. Therefore, the bellows 17 is prevented from being broken.

At Liquid Expanding Time in Zero-Down State

Figure 4:
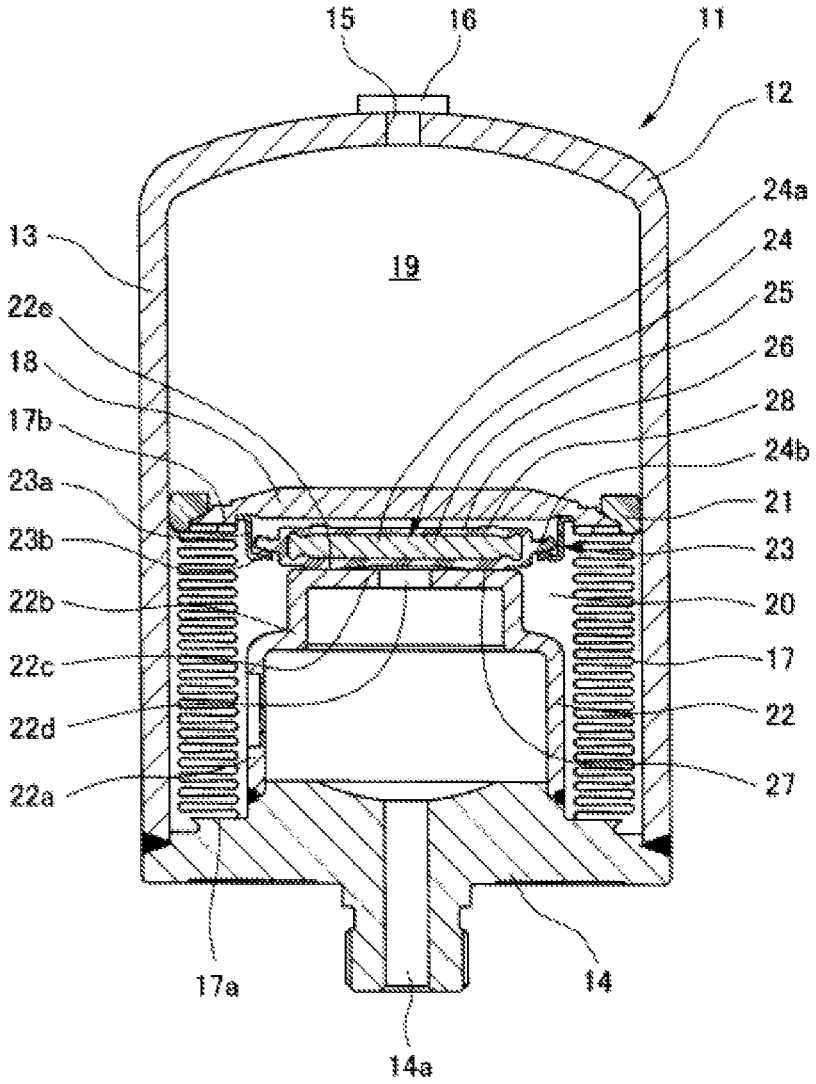
FIG. 4 is a cross-sectional view showing an activating state of the accumulator.

In the case that the liquid confined in the liquid chamber 20 and the gas encapsulated in the gas chamber 19 are expanded due to the rise of the atmospheric temperature in a state in the zero-down state shown in FIGS. 1 and 2, that is, the state in which the seal 24 seats on the seat surface 22*e* of the stay 22 and the liquid chamber 20 is occluded, the pressure difference is generated since the rising degree of the pressure is greater in the liquid than in the gas. As shown in FIG. 4, the seal holder 23 and the bellows cap 18 move to a position where the liquid pressure and the gas pressure are balanced toward an elongating direction of the bellows 17 on the basis of the pressure difference. Therefore, the balanced state of the liquid pressure and the gas pressure is maintained, and the bellows 17 is prevented from being broken. At the liquid expanding time, the seal 24 is kept seating on the seat surface 22*e* of the stay 22 due to the difference in the pressure receiving area in both the surfaces and does not move. Therefore, the liquid outlet and inlet 22*d* is kept closing, and the seal holder 23 and the bellows cap 18 move while the outer peripheral side engagement portion 23*b* of the seal holder 23 elastically deforming the inner peripheral side engagement portion 24*b* of the seal 24 diagonally upward.

At Dissolving Time of Zero-Down State

In the case that the zero-down state is dissolved and the liquid flows into from the port hole 14*a* of the oil port 14, the pressure of the liquid acts on the seal 24 and moves the seal 24 away from the seat surface 22*e* of the stay 22. Since the liquid is continuously introduced to the liquid chamber 20 from the liquid outlet and inlet 22*d*, the liquid directly acts on the bellows cap 18 and moves the seal holder 23 and the bellows cap 12 to a position where the liquid pressure and the gas pressure are balanced toward the elongating direction of the bellows 17. Therefore, it is returned to the initial state.

According to the accumulator 11 having the structure mentioned above, it is possible to reduce the pressure difference which is generated by the difference in expansion rate when the liquid confined in the liquid chamber 20 and the gas encapsulated in the gas chamber 19 are expanded at the zero-down time, by the movement of only the seal holder 23 and the bellows cap 18 without the movement of the seal 24. Therefore, it is possible to inhibit the bellows 17 from being broken due to the pressure difference between the inner and outer sides of the bellows 17. As a result, it is possible to improve durability of the bellows 17 and further of the accumulator 11.

Further, since the outward projection-like inner peripheral side engagement portion 24*b* constructed by the rubber-like elastic body is provided on the outer peripheral surface of the seal main body 24*a* constructing the seal 24, the outward projection-like inner peripheral side engagement portion 24*b* constructed by the rubber-like elastic body acts as the spring means by being combined with the outer peripheral side engagement portion 23*b* of the seal holder 23. Therefore, it is possible to omit the wave spring and the spring plate from the structure of the pressure absorption mechanism having the seal holder 23 and the seal 24. As a result, it is possible to reduce the number of the parts of the pressure fluctuation absorption mechanism, simplify the assembling and reduce the parts cost.

Figure 5:
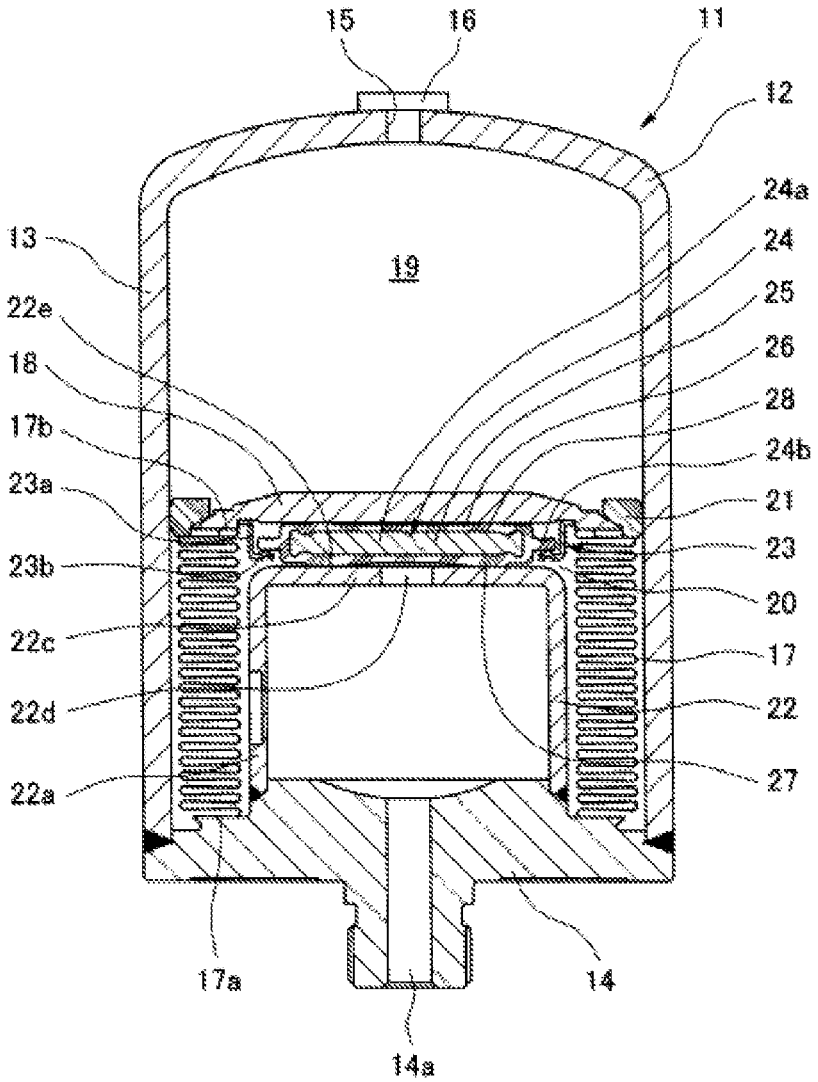
FIG. 5 is a cross-sectional view showing the other example of a stay which is provided in the accumulator.

Further, in the case that the wave spring and the spring plate are omitted as mentioned above, the seal holder 23 can be reduced its length, and does not interfere with the stay 22. Therefore, the stay 22 can employ a structure obtained by integrally forming the end surface portion 22*c* directly in one end (the upper end) of the tubular rising portion 22*a* toward the inner side in the diametrical direction without the step portion 22*b*, as shown in FIG. 5. As a result, it is possible to simplify the shape and the manufacturing of the stay 22.

Further, since the inner peripheral side engagement portion 24*b* is formed to be thinner than the seal main body 24*a* and formed to be thinner than the rigid plate 25 of the seal main body 24*a*, the inner peripheral side engagement portion 24*b* tends to be elastically deformed. Further, the inner peripheral side engagement portion 24*b* tends to be elastically deformed since it is divided into a plurality of sections circumferentially. Therefore, since the inner peripheral side engagement portion 24*b* which tends to be elastically deformed is combined with the outer peripheral side engagement portion 23*b*, the pressure fluctuation absorption mechanism having the combination of the inner peripheral side engagement portion 24*b* and the outer peripheral side engagement portion 23*b* can smoothly absorb the pressure fluctuation.

Second Embodiment

Figure 6:
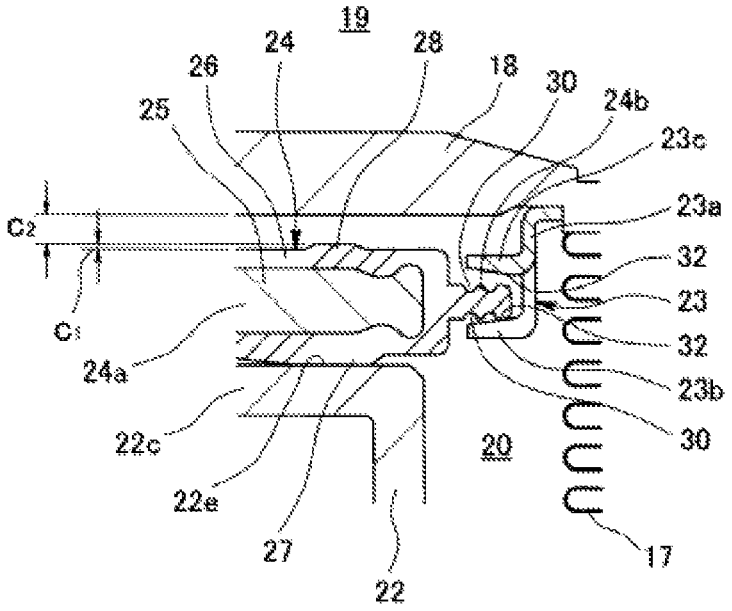
FIG. 6 is an enlarged cross-sectional view of a substantial part of an accumulator according to a second embodiment of the present invention.
Figure 7:
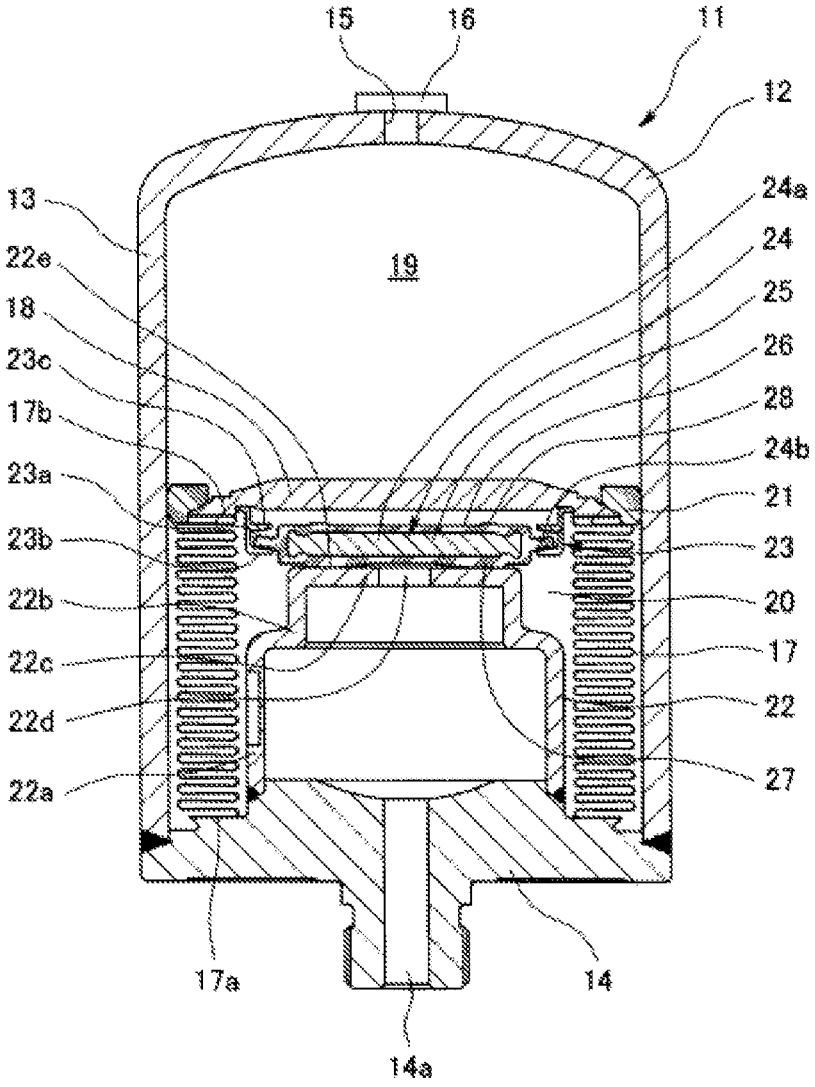
FIG. 7 is a cross-sectional view showing an activating state of the accumulator.
Figure 8:
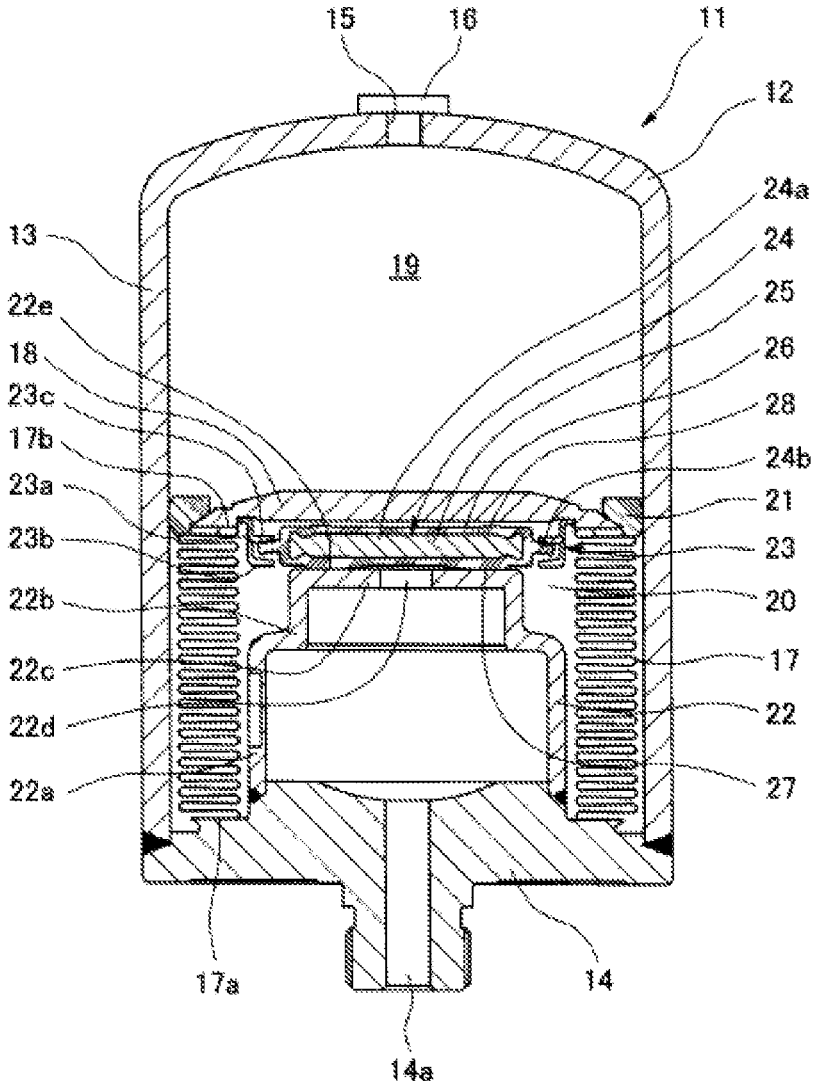
FIG. 8 is a cross-sectional view showing an activating state of the accumulator.
Figure 9:
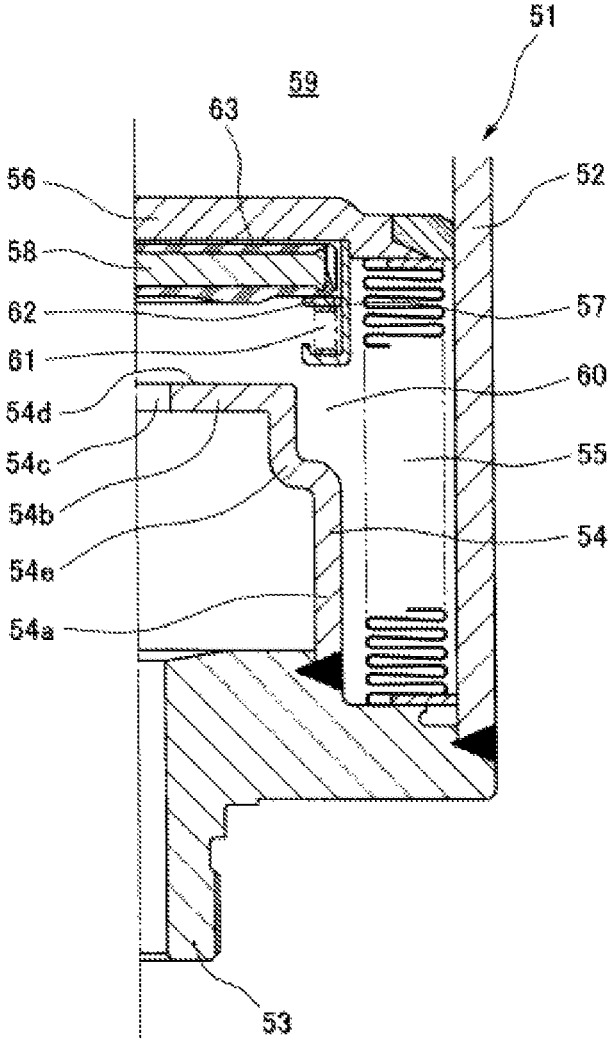
FIG. 9 is a cross-sectional view of a substantial part of an accumulator according to the prior art.
Figure 10:
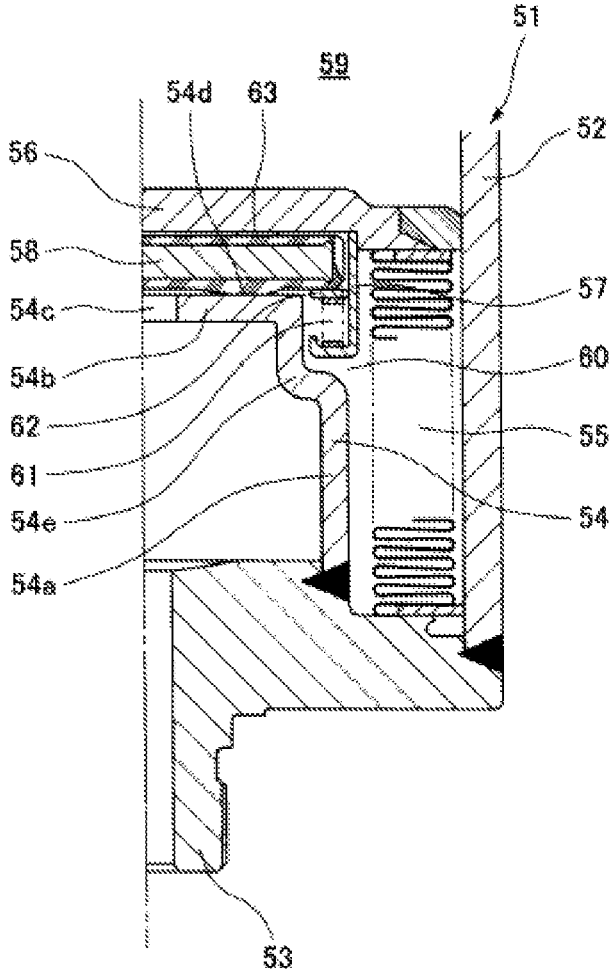
FIG. 10 is a cross-sectional view showing an activating state of the accumulator.
Figure 11:
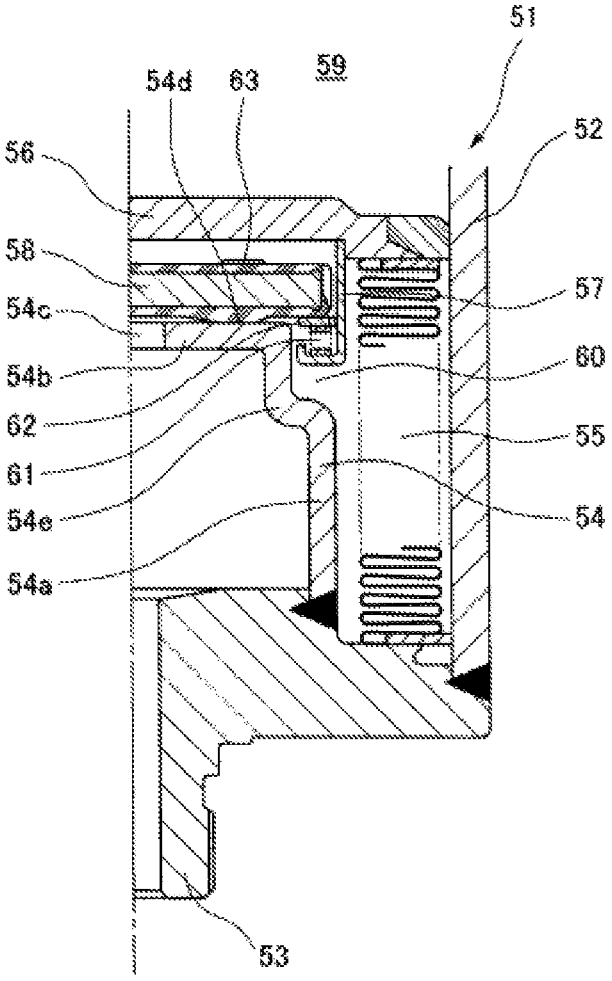
FIG. 11 is a cross-sectional view showing an activating state of the accumulator.

FIGS. 6 to 8 show an accumulator 11 according to a second embodiment of the present invention, and the accumulator 11 according to the second embodiment is provided with a different structure from the accumulator 11 according to the first embodiment in the following points.

More specifically, as shown in FIG. 6, an inward flange-like second outer peripheral side engagement portion 23*c* is provided in the same manner close to the bellows cap 18 side (the upper side) of the inward flange-like outer peripheral side engagement portion (the first outer peripheral side engagement portion) 23*b*, in the structure of the seal holder 23, and the inner peripheral side engagement portion 24*b* of the seal 24 is arranged between both the outer peripheral side engagement portions 23*b* and 23*c*.

The seal holder 23 is obtained by integrally forming the inward flange-like outer peripheral side engagement portion 23*b* in one end (the lower end) of the attaching portion 23*a* having the tubular shape toward the inner side in the diametrical direction, and integrally forming the second outer peripheral side engagement portion 23*c* having the same inward flange shape close to the bellows cap 18 side (the upper side) of the outer peripheral side engagement portion 23*b*, and is fixed (fitted) to the peripheral edge portion of the concave portion which is provided in the surface close to the oil port 14 side in the bellows cap 18 with the other end bent portion (the upper end bent portion) of the attaching portion 23*a*. The outer peripheral side engagement portion 23*b* and the second outer peripheral side engagement portion 23*c* are provided with tongue pieces circumferentially and alternately by press machining.

Further, an initial gap c2 is set between the seal 24 and the bellows cap 18. The other structures are set to the same as those of the first embodiment.

Next, a description will be given of an activation of the accumulator 11 having the above structure.

Steady Activating Time

The accumulator 11 is connected to the pressure piping of the device (not shown) in the oil port 14. Since the seal 24 is away from the seat surface 22*e* of the stay 22 by moving together with the seal holder 23 and the bellows cap 18 in a state in which the seal is retained by the seal holder 23 at the steady activating time of the pressure piping in the device, the liquid outlet and inlet 22*d* provided in the end surface portion 22*c* of the stay 22 is open. As a result, the port hole 14*a* of the oil port 14 and the liquid chamber 20 are communicated through the liquid outlet and inlet 22*d*, and the liquid having the current pressure is introduced as needed to the liquid chamber 20 from the port hole 14*a* of the oil port 14. Therefore, the bellows cap 18 can move as needed together with the seal holder 23 and the seal 24 so that the liquid pressure and the gas pressure are balanced.

At Zero-Down Time

In the case that the pressure of the pressure piping is extremely lowered to approximately zero from the state at the steady activating time due to the operation stop of the device so as to come to a so-called zero-down state, the liquid within the liquid chamber 20 is discharged little by little from the port hole 14*a* of the oil port 14, and the bellows cap 18 moves in a contracting direction of the bellows 17 in connection with this. Since the seal 24 is retained to the surface close to the stay 22 side of the bellows cap 18, the seal 24 seats on the seat surface 22*e* of the stay 22 in its seal portion 27 as shown in FIG. 6, and the liquid outlet and inlet 22*d* is closed. Therefore, the liquid chamber 20 is occluded, and the partial liquid is confined in the liquid chamber 20. As a result, further pressure reduction of the liquid chamber 20 is not generated, and the liquid pressure and the gas pressure are accordingly balanced inside and outside the bellows 17. Therefore, the bellows 17 is prevented from being broken.

At Liquid Expanding Time in Zero-Down State

In the case that the liquid confined in the liquid chamber 20 and the gas encapsulated in the gas chamber 19 are expanded due to the rise of the atmospheric temperature in a state in the zero-down state, that is, the state in which the seal 24 seats on the seat surface 22*e* of the stay 22 and the liquid chamber 20 is occluded, the pressure difference is generated since the rising degree of the pressure is greater in the liquid than in the gas. As shown in FIG. 7, the seal holder 23 and the bellows cap 18 move to a position where the liquid pressure and the gas pressure are balanced toward an elongating direction of the bellows 17 on the basis of the pressure difference. Therefore, the balanced state of the liquid pressure and the gas pressure is maintained, and the bellows 17 is prevented from being broken. At the liquid expanding time, the seal 24 is kept seating on the seat surface 22*e* of the stay 22 due to the difference in the pressure receiving area in both the surfaces and does not move. Therefore, the liquid outlet and inlet 17*d* is kept closing, and the seal holder 23 and the bellows cap 18 move with the outer peripheral side engagement portion 23*b* of the seal holder 23 elastically deforming the inner peripheral side engagement portion 24*b* of the seal 24 diagonally upward as shown.

At Liquid Contracting Time in Zero-Down State

Further, in the case that the liquid confined in the liquid chamber 20 and the gas encapsulated in the gas chamber 19 are contracted due to the reduction of the atmospheric temperature in a state in the zero-down state, that is, the state in which the seal 24 seats on the seat surface 22*e* of the stay 22 and the liquid chamber 20 is occluded, the pressure difference is generated since the reducing degree of the pressure is greater in the liquid than in the gas. As shown in FIG. 8, the seal holder 23 and the bellows cap 18 move to a position where the liquid pressure and the gas pressure are balanced toward an contracting direction of the bellows 17 on the basis of the pressure difference. Therefore, the balanced state of the liquid pressure and the gas pressure is maintained, and the bellows 17 is prevented from being broken. At the liquid contracting time, the seal 24 is kept seating on the seat surface 22*e* of the stay 22 due to the difference in the pressure receiving area in both the surfaces and does not move. Therefore, the liquid outlet and inlet 17*d* is kept closing, and the seal holder 23 and the bellows cap 18 move with the second outer peripheral side engagement portion 23*c* of the seal holder 23 elastically deforming the inner peripheral side engagement portion 24*b* of the seal 24 diagonally downward as shown.

At Dissolving Time of Zero-Down State

In the case that the zero-down state is dissolved and the liquid flows into from the port hole 14*a* of the oil port 14, the pressure of the liquid acts on the seal 24 and moves the seal 24 away from the seat surface 22*e* of the stay 22. Since the liquid is continuously introduced to the liquid chamber 20 from the liquid outlet and inlet 22*d*, the liquid directly acts on the bellows cap 18 and moves the seal holder 23 and the bellows cap 12 to a position where the liquid pressure and the gas pressure are balanced toward the elongating direction of the bellows 17. Therefore, it is returned to the initial state.

According to the accumulator having the structure mentioned above, the same effects as those of the first embodiment can be achieved. In addition, since the inner peripheral side engagement portion 24*b* of the seal 24 is combined with both of the first and the second outer peripheral side engagement portions 23*b*, 23*c* of the seal holder 23, the pressure fluctuation can be absorbed not only when the liquid confined in the liquid chamber 20 is expanded but also when it is contracted.

Further, in common between the first and second embodiments, the accumulator 11 may be provided with the following structures.

The inner peripheral side engagement portion 24*b* tends to be further elastically deformed by the provision of a groove (concavity) formed into an annular shape or extending in a circumferential direction on a surface (an upper surface) close to the bellows cap 18 side and/or a surface (a lower surface) close to the oil port 14 side in the inner peripheral engagement portion 24*b* of the seal 24. In the above first embodiment, the groove 30 is provided on the surface (the upper surface) close to the bellows cap 18 side in the inner peripheral side engagement portion 24*b* as shown in FIG. 2. In the second embodiment, the groove 30 is provided in each of the surface (the upper surface) close to the bellows cap 18 side and the surface (the lower surface) close to the oil port 14 side in the inner peripheral side engagement portion 24*b* as shown in FIG. 6.

Further, a friction resistance at the contacting time with the inner peripheral side engagement portion 24*b* is reduced by the provision of a convex shape formed into a circular arc cross-section or an inclined surface shape formed into a conical surface on a surface (an upper surface) close to the bellows cap 18 side in the outer peripheral side engagement portion 23*b* or/and a surface (a lower surface) close to the oil port 14 side in the second outer peripheral side engagement portion 23*c* of the seal holder 23. Further, a scuff mark is prevented from being formed on the inner peripheral side engagement portion 24*b*. In the above first embodiment, the convex shape 31 formed into the circular arc cross-section is provided on the surface (the upper surface) close to the bellows cap 18 in the outer peripheral side engagement portion 23*b* as shown in FIG. 2. In the second embodiment, the inclined surface shape 32 is provided on each of the surface (the upper surface) close to the bellows cap 18 side in the outer peripheral side engagement portion 23*b* and the surface (the lower surface) close to the oil port 14 side in the second outer peripheral side engagement portion 23*c* as shown in FIG. 6.

In order to facilitate the flowing of the expanded or contracted liquid between the outer peripheral side and the inner peripheral side of the seal holder 23, a flow path constructed by a hole or a groove may be provided in the seal holder 23.

Further, in the second embodiment, since the distance between the first and the second outer peripheral side engagement portions 23*b*, 23*c* of the seal holder 23 is set to be greater than the thickness of the inner peripheral side engagement portion 24*b* of the seal 24 as shown in FIG. 6, an initial gap is set here. However, the initial gap may not be set.

Further, in the first and second embodiments, the accumulator 11 is constructed as the external gas type accumulator by setting the gas chamber 19 in the outer peripheral side of the bellows 17 and setting the liquid chamber 20 in the inner peripheral side of the bellows 17, however, the type of the accumulator 11 may be contrarily constructed as an internal gas type accumulator in which the gas chamber 19 is set in the inner peripheral side of the bellows 17 and the liquid chamber 20 is set in the outer peripheral side of the bellows 17.

Further, in the case that the bellows 17 is adapted to be suspended from a ceiling portion of the housing 12, the stay 22 may be omitted. In this case, the inner surface (the surface (the upper surface) close to the seal 24 side) of the oil port 14 may be formed as the seat surface.

What is claimed is:

1. An accumulator comprising:

an accumulator housing which is provided with an oil port connected to a pressure piping;

a bellows and a bellows cap which are arranged within said housing and compart a space within said housing into a liquid chamber communicating with said oil port and a gas chamber encapsulating gas therein;

a seal holder which is provided in said bellows cap; and a plate-like seal which is retained by said seal holder, wherein said seal holder is provided with an attaching portion to said bellows cap, and an inward flange-like outer peripheral side engagement portion, and wherein said seal is provided with a seal main body which has a smaller diameter than an inner diameter of said outer peripheral side engagement portion, and an outward projection-like inner peripheral side engagement portion which is arranged in an outer peripheral surface of said seal main body and is only made of a rubber-like elastic body directly engaging with said outer peripheral side engagement portion.

2. The accumulator according to claim 1, wherein said seal holder is provided with an inward flange-like second outer peripheral side engagement portion in the same manner in a bellows cap side of said outer peripheral side engagement portion, wherein said seal is structured such that said inner peripheral side engagement portion is arranged between said outer peripheral side engagement portion and said second outer peripheral side engagement portion, and wherein an initial gap is set between said seal and said bellows cap.

3. The accumulator according to claim 2, wherein said inner peripheral side engagement portion is formed thinner than said seal main body.

4. The accumulator according to claim 1, wherein said inner peripheral side engagement portion is formed thinner than said seal main body.

5. The accumulator according to claim 1, wherein an elastic body defines a coating around the seal main body, the elastic body including a first major surface that is configured to engage the bellow cap, a second major surface that is opposite to the first major surface, and a pair of side surfaces that connect the first and second major surfaces, and the outward projection-like inner peripheral side engagement portion extends outward from an outer peripheral surface of one of the sides surfaces that is part of the elastic body.

* * * * *